US008421566B2

(12) United States Patent
Sasao et al.

(10) Patent No.: US 8,421,566 B2
(45) Date of Patent: Apr. 16, 2013

(54) LINEAR SOLENOID

(75) Inventors: Kazuhiro Sasao, Chiryu (JP); Akinori Hirano, Nagoya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 13/303,375

(22) Filed: Nov. 23, 2011

(65) Prior Publication Data

US 2012/0154079 A1 Jun. 21, 2012

(30) Foreign Application Priority Data

Dec. 20, 2010 (JP) ..... 2010-283284

(51) Int. Cl.
*H01F 7/00* (2006.01)

(52) U.S. Cl.
USPC ..... 335/278; 335/220; 336/107

(58) Field of Classification Search ..... 335/220–223, 335/278, 281, 282; 361/107
See application file for complete search history.

(56) References Cited

U.S. PATENT DOCUMENTS 5,125,432 A 6/1992 Fujii et al.
5,153,550 A * 10/1992 Sugiura et al. ..... 336/192
5,746,412 A * 5/1998 Niimi ..... 251/129.15
7,151,427 B2 12/2006 Muller et al.
8,264,313 B2 * 9/2012 Sasao et al. ..... 335/282
2005/0184841 A1 * 8/2005 Ryuen et al. ..... 335/220
2006/0186976 A1 * 8/2006 Kamidate et al. ..... 335/220
2006/0243938 A1 * 11/2006 Ishibashi et al. ..... 251/129.15

FOREIGN PATENT DOCUMENTS

JP 62-134210 U 8/1987
JP 04-93004 A 3/1992
JP 2004-518302 A 6/2004
JP 2005315316 11/2005

OTHER PUBLICATIONS

Office Action issued Dec. 18, 2012 in corresponding Japanese Application No. 2010-283284 with English translation.

* cited by examiner

*Primary Examiner* — Bernard Rojas

(57) ABSTRACT

A linear solenoid includes a coil assembly having a coil, and a cup-shaped yoke arranged at an outer peripheral side of the coil. The yoke is provided with a recess portion that is opened at least at a position in a circumferential direction of the yoke and extends in an axial direction of the yoke. The coil assembly includes a connector portion that has a terminal connected to an exterior and is exposed from the recess portion to an exterior of the yoke, and a secondary molding portion made of a secondary molding resin in which the coil is insert-molded. Furthermore, the secondary molding portion includes a cover portion that is arranged to cover the recess portion of the yoke from an outer peripheral side of the recess portion. Thus, the cover portion can restrict foreign-material mixed oil from being introduced into the yoke.

6 Claims, 5 Drawing Sheets

TOP
BOTTOM
AXIAL DIRECTION
1
5
35
19
33
54
52
14
24
20
31
46
44
57
53
51
55
32
45, 55
14
54
44
52
45, 55
33
53
51
20
46
24

LINEAR SOLENOID

CROSS REFERENCE TO RELATED APPLICATION

This application is based on Japanese Patent Application No. 2010-283284 filed on Dec. 20, 2010, the contents of which are incorporated herein by reference in its entirety.

TECHNICAL FIELD

The present invention relates to a linear solenoid.

BACKGROUND

Conventionally, a linear solenoid is used for a solenoid oil-pressure control valve (i.e., solenoid hydraulic control valve). The linear solenoid includes a coil assembly, a cup-shaped yoke, a plunger and a stator. The coil assembly includes a coil which generates a magnetic force when being energized, and the cup-shaped yoke is arranged outside of the coil to pass therethrough magnetic flux. The plunger is arranged slidably at an inner peripheral side of the coil assembly, and the stator is disposed to attract the plunger by the magnetic force generated when electrical current is applied to the coil.

The yoke is provided with an open portion through which a terminal connected to an exterior equipment leads out so as to supply an electrical power to the coil.

The linear solenoid used for the solenoid oil-pressure control valve is generally provided at a position to which oil with a foreign material is easily sprinkled. Thus, the foreign-material mixed oil may be introduced into the yoke from the open portion that is provided for the terminal, and may stay inside of the yoke. If the foreign-material mixed oil stays inside of the yoke, the foreign-material mixed oil may reach to the plunger, and thereby sliding performance of the plunger may be affected. Thus, it is required to restrict the foreign-material mixed oil from being introduced into the yoke from the open portion.

In Patent Document 1 (JP 2005-315316A), an open portion for a terminal (i.e., terminal window) is provided at a bottom wall of a yoke and is covered by a cover from an outside of the yoke, so as to prevent foreign-material mixed oil from flowing into an inside of the yoke.

However, in Patent Document 1, because the cover is provided separately from the yoke, the structure of the linear solenoid becomes complex, thereby increasing the cost. Furthermore, the linear solenoid of Patent Document 1 does not have a function for discharging the foreign-material mixed oil to outside of the yoke after the foreign-material mixed oil is introduced once into the yoke. Thus, the foreign-material mixed oil may continuously stay in the yoke after being introduced into the inside of the yoke.

SUMMARY

The present invention is made in view of the above matters, and it is an object of the present invention to provide a linear solenoid, which can restrict foreign-material mixed oil from being introduced into a yoke from an open portion for a terminal, without increasing component number.

It is another object of the present invention to provide a linear solenoid, which can discharge foreign-material mixed oil to outside of the yoke even if the foreign-material mixed oil is introduced into the yoke.

According to an aspect of the present invention, a linear solenoid includes a coil assembly including a coil which generates a magnetic flux when being energized, and a cup-shaped yoke arranged at an outer peripheral side of the coil and configured to pass therethrough the magnetic flux. The yoke is provided with a recess portion that is opened at least at a position in a circumferential direction of the yoke and extends in an axial direction of the yoke. The coil assembly further includes a connector portion that has a terminal connected to an exterior and is exposed from the recess portion to an outside of the yoke, and a secondary molding portion made of a secondary molding resin in which the coil is insert-molded. Furthermore, the secondary molding portion includes a cover portion that is arranged to cover the recess portion of the yoke from an outer peripheral side of the recess portion. Thus, the recess portion of the yoke is adapted as an open portion for the terminal. Even in this case, because the cover portion is provided in the secondary molding portion, it can restrict foreign-material mixed oil from being introduced into the yoke from the recess portion adapted as the open portion for the terminal, without increasing component number.

For example, the secondary molding portion may further include a coil molding portion arranged to cover an outer periphery of the coil, and a holding portion that protrudes from an outer periphery of the coil molding portion to an outer peripheral side and holds the cover portion at the outer peripheral side of the recess portion of the yoke. In this case, the holding portion may be provided with a discharge passage through which oil flowing out of the recess portion is discharged toward an axial open portion of the recess portion. Thus, even if foreign-material mixed oil is introduced into the yoke, it is possible to easily discharge the foreign-material mixed oil to outside of the yoke.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION

Figure 1:
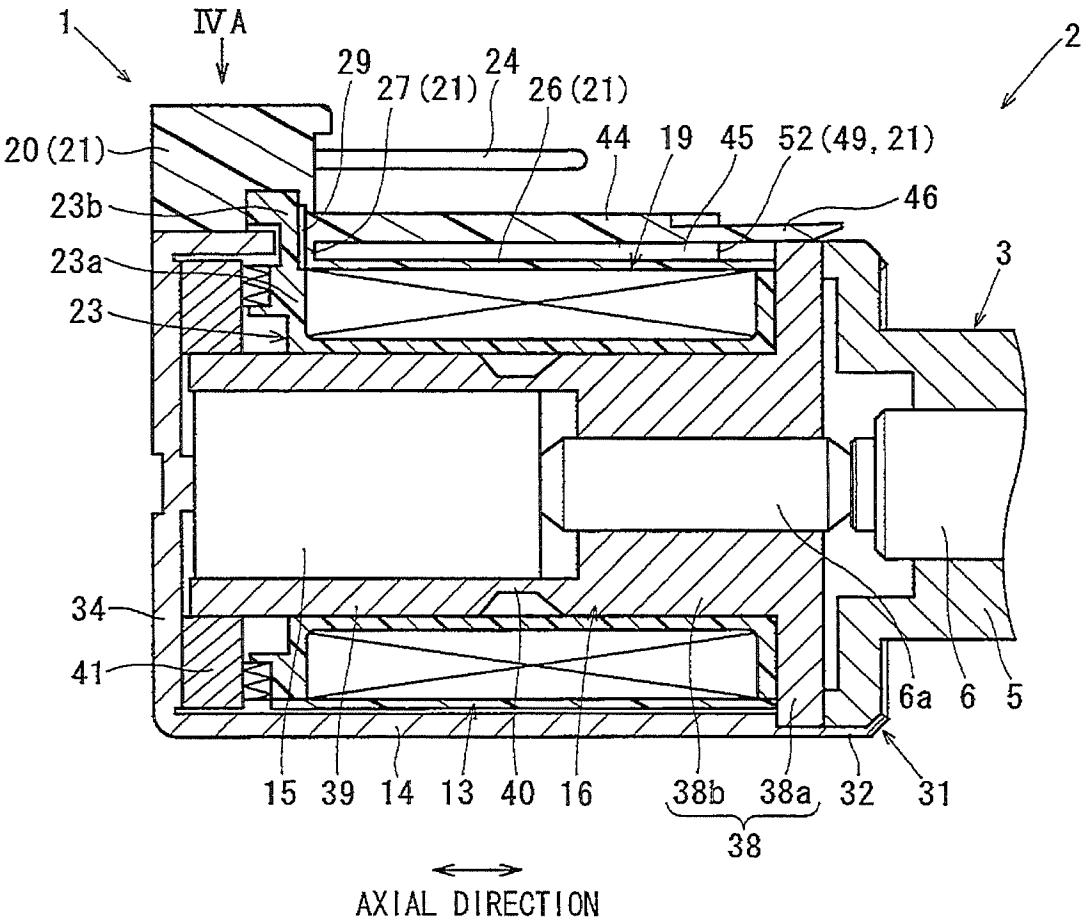
FIG. 1 is a cross-sectional view showing a linear solenoid for a solenoid oil-pressure control valve, according to an embodiment of the invention.

A linear solenoid 1 of the present invention includes a coil assembly 13 including a coil 19 which generates a magnetic flux when being energized, and a cup-shaped yoke 14 arranged at an outer peripheral side of the coil 19 and configured to pass therethrough the magnetic flux. The yoke 14 is provided with a recess portion 33 that is opened at least at a position in a circumferential direction of the yoke 14 and extends in an axial direction of the yoke 14. The coil assembly 13 further includes a connector portion 20 that has a terminal 24 connected to an exterior and is exposed from the recess portion 33 to an outside of the yoke 14 when the coil 19 is arranged in the yoke 14. Therefore, the recess portion 33 is used as an open portion for a terminal connection. The coil assembly 13 is provided with a secondary molding portion 21 made of a secondary molding resin in which the coil 19 is insert-molded. Furthermore, the secondary molding portion 21 includes a cover portion 44 that is arranged to cover the recess portion 33 of the yoke 14 from an outer peripheral side of the recess portion 33. That is, the cover portion 44 is formed by using a part of the secondary molding portion 21. Thus, it can restrict foreign-material mixed oil from being introduced into the yoke 14 from the recess portion 33, by the cover portion 44 that is a part of the secondary molding portion 21.

Embodiments

A typical example of a linear solenoid 1 according to an embodiment of the invention will be described with reference to FIGS. 1 to 5B. In the present embodiment, the linear solenoid 1 is typically used for a solenoid oil-pressure control valve 2 (i.e., solenoid hydraulic control valve) mounted to an oil-pressure control device for an automatic transmission, for example.

As shown in FIG. 1, the solenoid oil-pressure control valve 2 includes a spool valve 3, and the linear solenoid 1 for driving the spool valve 3. The spool valve 3 is configured to include a cylindrical sleeve 5 having an oil port (not shown), and a spool 6 arranged to be slidable in the sleeve 5 to open or close the oil port. The spool 6 includes a shaft 6*a* that is arranged to contact a plunger 15 of the linear solenoid 1, so that the spool 6 is slidable in an axial direction by a drive force of the plunger 15 of the linear solenoid 1 via the shaft 6*a*.

Figure 2B:
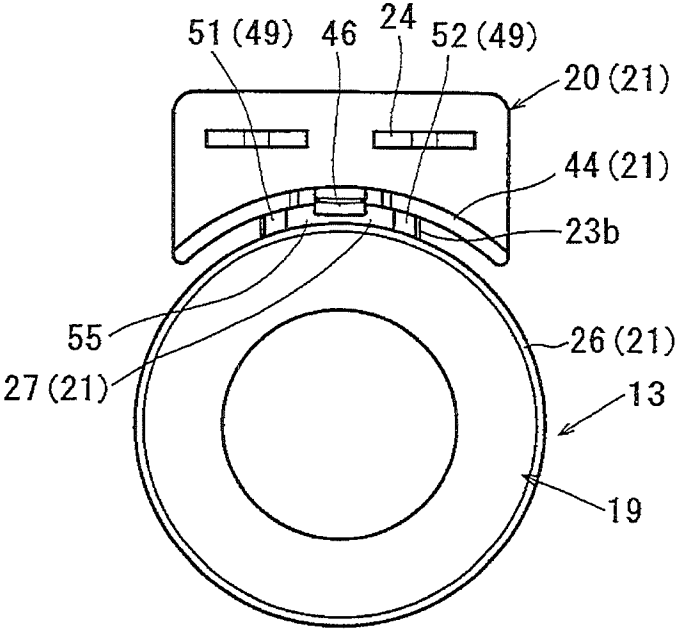
FIG. 2B is a top view showing the coil assembly according to the embodiment.
Figure 2A:
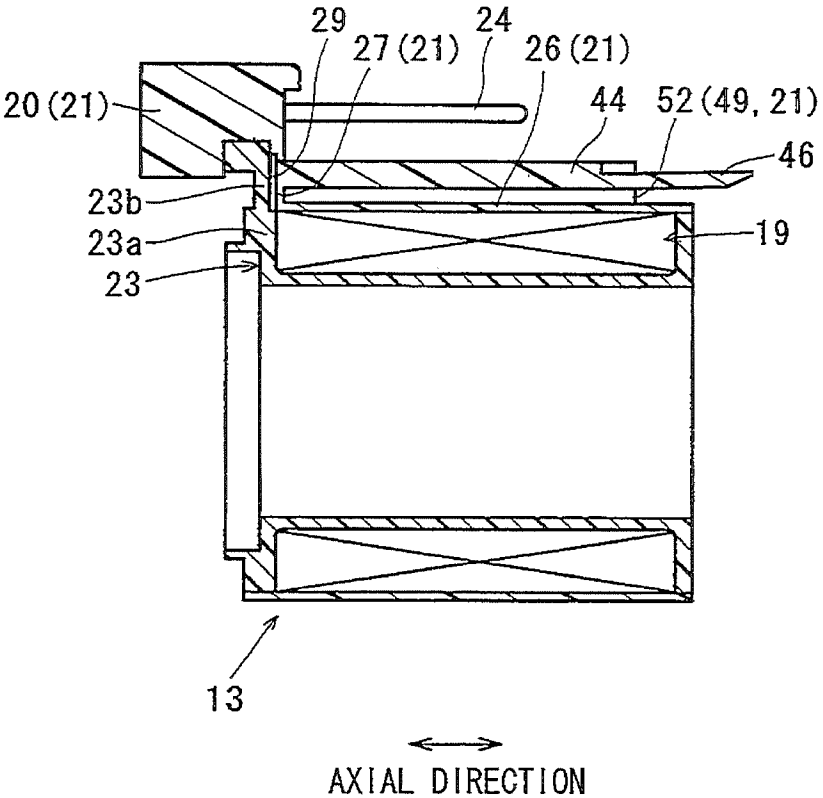
FIG. 2A is a cross-sectional view showing a coil assembly according to the embodiment.

Next, a basic structure of the linear solenoid 1 will be described. As shown in FIG. 1, the linear solenoid 1 includes a coil assembly 13, a yoke 14, the plunger 15 and a stator 16. Furthermore, the coil assembly 13 includes a coil 19, a connector portion 20, and a secondary molding portion 21. The coil 19 is further insert-molded by using a secondary molding resin, thereby forming the secondary molding portion 21, as shown in FIGS. 1, 2A and 2B. The connector portion 20 may be formed as a part of the secondary molding portion 21.

The coil 19 generates a magnetic force when an electrical power is supplied to the coil 19. Wires with insulation cover at its outer peripheral surfaces are wound on an outer periphery of a resinous bobbin 23, thereby forming the coil 19.

The connector portion 20 is formed by using a part of the secondary molding resin, such that a pair of terminals 24 for an exterior connection are held at an outer peripheral side of the yoke 14. In the present embodiment, the connector portion 20 may be provided to configure the secondary molding portion 21.

Thus, the secondary molding portion 21 is configured to include the coil molding portion 26 that is resin-molded at the outer cylindrical periphery of the coil 19, an extension portion 27 extending radially outside of the coil molding portion 26 at one axial end side of the coil molding portion 26, and the connector portion 20 connected at an outer peripheral side of the extension portion 27. The extension portion 27 protrudes from the coil molding portion 26 radially outside to the connector portion 20, at one axial end side of the coil 19, so that the connector portion 20 is held at the one axial end side of the coil 19.

The coil 19 and the terminals 24 are insert-molded integrally by using the second molding resin, thereby simultaneously forming the coil molding portion 26, the extending portion 27 and the connector portion 20 by using the secondary molding resin.

A flange portion 23*a* is formed at the one axial end of the bobbin 23 to have a protrusion portion 23*b* protruding radially outside from the flange portion 23*a*. One end portion 29 of a winding wire of the coil 19 is insert-molded on a surface of the protrusion portion 23*b* by using the secondary molding resin forming the extension portion 27. Thus, the one end portion 29 of the winding wire of the coil 19 is inserted between the protrusion portion 23*b* and the extension portion 27 in the axial direction, at the one axial end side of the coil 19, as shown in FIGS. 1 and 2A. The one end portion 29 of the coil 19 is connected to the terminal 24 within the connector portion 20.

The yoke 14 is arranged at an outer peripheral side of the coil 19, and is formed from a magnetic metal into a cylindrical cup shape so that the magnetic flux at the outer peripheral side of the coil 19 passes through the yoke 14. That is, the yoke 14 is formed into a cylindrical cup shape having an axial bottom wall 34 at one axial end side, and an axial open portion 31 at the other axial end side. More specifically, a thin wall portion 32 is provided at the axial open portion 31 of the yoke 14, and is fastened to an axial one end portion of the sleeve 5 to be fixed to the sleeve 5.

Figure 3:
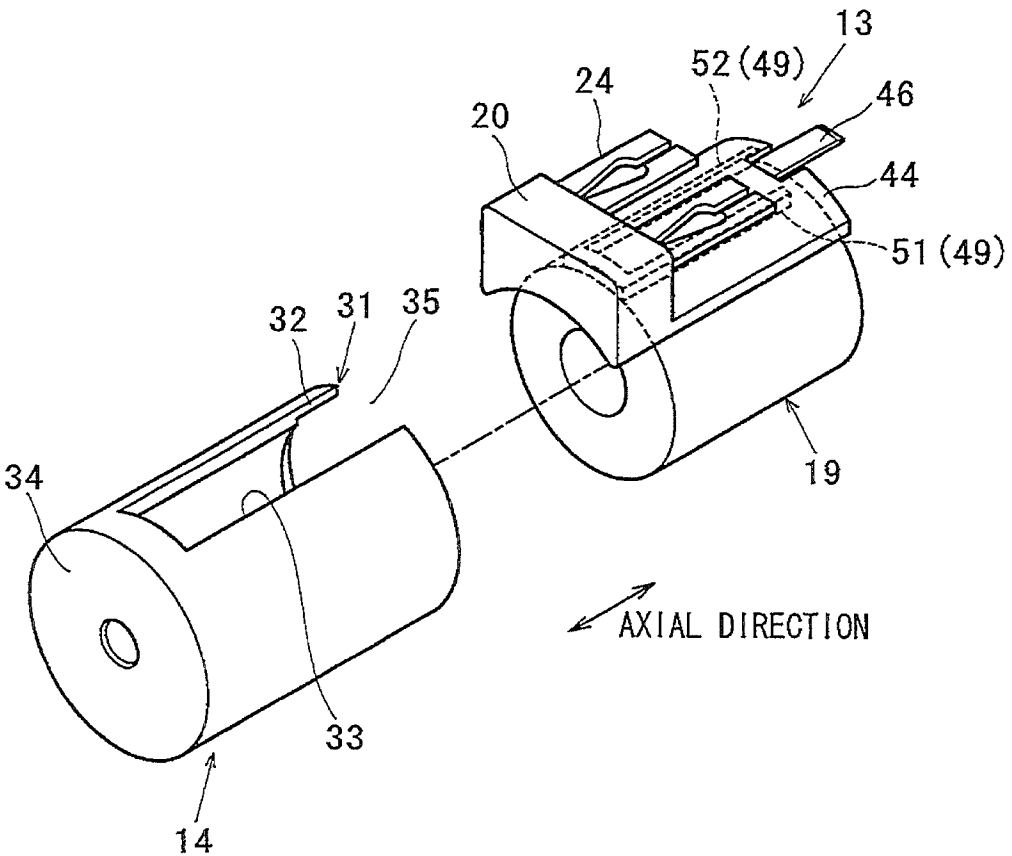
FIG. 3 is disassembled perspective view showing the coil assembly and a yoke, in a state where the coil assembly is disassembled from the yoke, according to the embodiment.

A recess portion 33 is provided in the yoke 14 by cutting out a part of a circumferential wall portion to have an open opened in a radial direction and extending to an axial open portion 35 in an axial direction with a predetermined circumference range, as shown in FIG. 3. That is, the recess portion 33 is open in an area in the circumferential direction of the yoke 14 at least at one position in the circumferential direction, and the opened recess portion 33 with a predetermined circumferential length extends in the axial direction from a position separated from the bottom wall 34 to the axial open portion 35. The yoke 14 is formed into a cylindrical cup shape with the bottom wall 34 and the open portion 31. The recess portion 33 extends in the axial direction from the open portion 31 to a portion separated from the bottom wall 34 in the axial direction, in a predetermined area in the circumferential direction. That is, one axial end of the yoke 14 is covered by the bottom wall 34, and the other axial end of the yoke 14 is open at the open portion 35. The recess portion 33 (cutout open portion) is formed in a U-shape to extend in the axial direction, and is also open axially at the open portion 35.

In a state where the coil 19 is arranged in and is attached into the yoke 14, the connector portion 20 protrudes from the recess portion 33 to outside of the yoke 14, as shown in FIG. 1. As shown in FIG. 3, the coil 19 is inserted into the yoke 14 from the axial open portion 31 of the yoke 14 while the position of the recess portion 33 consists with the position of the connector portion 20, so that the connector portion 20 protrudes outside of the yoke 14 via the recess portion 33. Thus, a part of the connector portion 20 is positioned on an outer peripheral surface of the yoke 14, at the one axial end side of the recess portion 33. Therefore, the recess portion 33 is used as a terminal open portion through which the terminal 24 connected to the coil 19 is introduced outside of the yoke 14.

The plunger 15 is formed from a ferromagnetic material such as iron into a cylindrical shape. The plunger 15 is arranged to be directly slidable on an inner peripheral surface of the stator 16. One axial end surface of the plunger 15 is positioned at a side of the bottom wall 34 of the yoke 14, and the other axial end surface of the plunger 15 is made to contact the shaft 6*a* of the spool 6. The plunger 15 is biased at the one end side of the spool 6, together with the shaft 6*a*.

The stator 16 is formed of a ferromagnetic material such as iron, and includes an attraction stator 38 and a slidable stator 39. The attraction stator 38 is arranged at the other axial end side of the plunger 15 to magnetically attract the other axial end side of the plunger 15. The slidable stator 39 is provided to cover an outer periphery of the plunger 15 so that magnetic flux passes radially between the plunger 15 and the slidable stator 39. Furthermore, a shutting portion 40 is provided between the attraction stator 38 and the slidable stator 39 to shut the magnetic flux therebetween.

The attraction stator 38 includes a flange portion 38*a* magnetically connected with the axial open portion 31 of the yoke 14, and an attraction portion 38*b* that is arranged to be opposite to the other axial end side of the plunger 15 and to support the shaft 6*a* to be slidable in the axial direction. Furthermore, the attraction stator 38 is provided so that a magnetic attraction space portion (main magnetic gap) is formed between the attraction portion 38*b* and the plunger 15. The flange portion 38*a* and the one axial end portion of the sleeve 5 are tightly connected and fitted by fastening the thin wall portion 32 formed at the open portion 31 of the yoke 14.

The slidable stator 39 is provided at one end side of the attraction stator 38 in the axial direction, and is formed into a cylindrical shape enclosing the outer periphery of the plunger 15 so that the plunger 15 is slidable on an inner peripheral surface of the slidable stator 39. A ring-shaped auxiliary core 41 is made of a ferromagnetic material such as iron, and is provided to supplement a magnetic connection between the slidable stator 39 and the yoke 14.

According to the linear solenoid 1 of the present embodiment, the secondary molding portion 21 is formed from the secondary molding resin, and the recess portion 33 is covered by a cover portion 44 from an outer peripheral side of the recess portion 33 of the yoke 14. The cover portion 44 is a part of the secondary molding portion 21 in which the coil 19 is insert-molded by using the secondary molding resin.

That is, the cover portion 44 is also formed by using the secondary molding resin, in addition to the coil molding portion 26, the extending portion 27 and the connector portion 20.

The cover portion 44 is formed in a window-roof shape to extend in the axial direction from the surface of the extension portion 27 to the other axial end side of the yoke 14 (i.e., the side of the open portion 35), as shown in FIGS. 1 to 3. The cover portion 44 is provided to extend in the axial direction from an inner peripheral portion of the connector portion 20 provided at the one axial end side of the coil 19, to the side of the axial open portion 31 of the yoke 14.

Figures 4A, 4B, 4C:
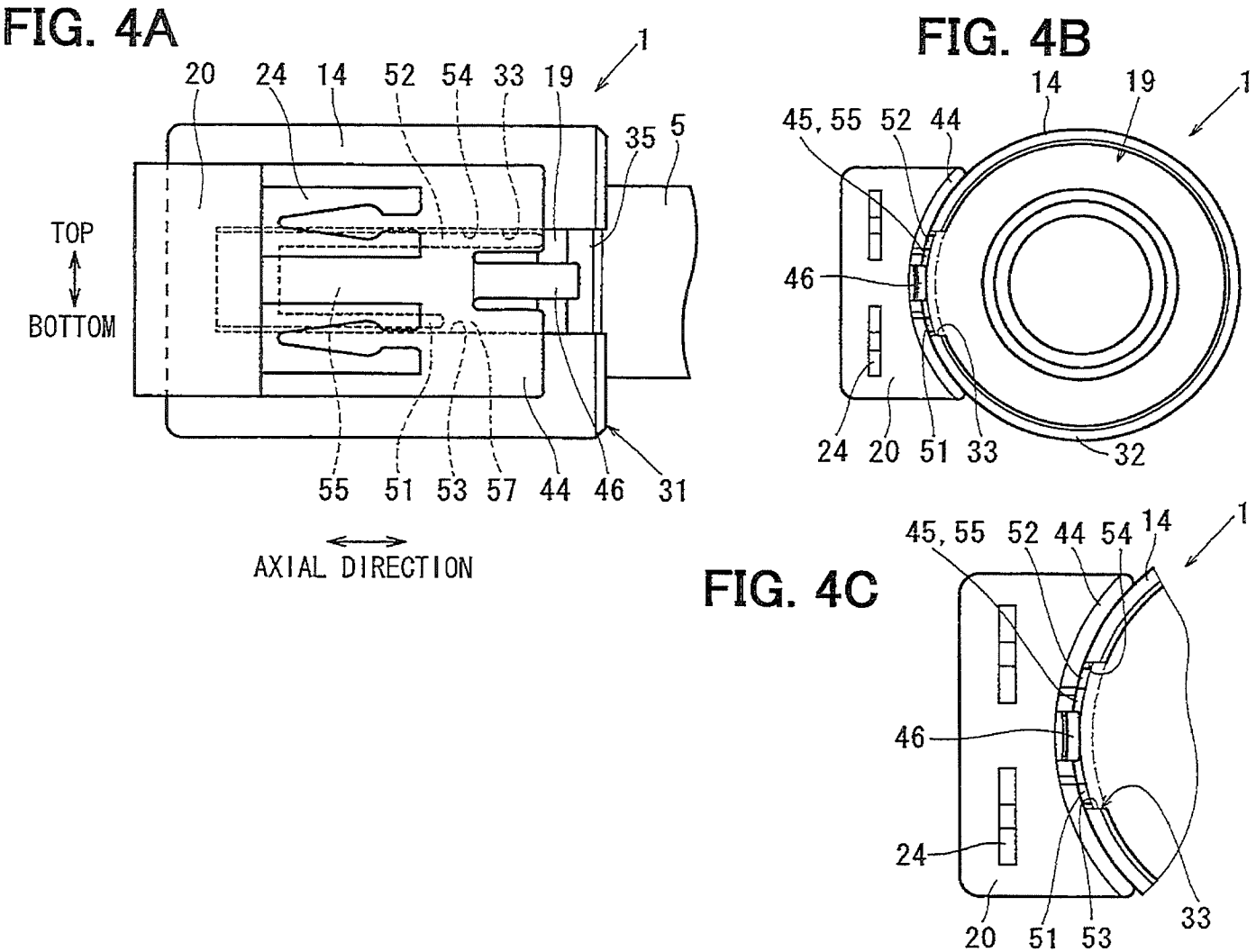
FIG. 4A is a side view showing the linear solenoid when being viewed from the arrow IVA in FIG. 1.
FIG. 4B is an axial view showing the linear solenoid when being viewed from an axial direction.
FIG. 4C is an enlarged view showing a part of the linear solenoid shown in FIG. 4B, according to the embodiment.

The cover portion 44 extends in the circumferential direction and the axial direction so as to form a part of a cylindrical wall. That is, a cross section of the cover portion 44 is formed into a circular arc shape along the outer peripheral surface of the yoke 14. Furthermore, an inner peripheral surface of the cover portion 44 is provided to contact the outer peripheral surface of the yoke 14, as shown in FIGS. 4B and 4C. Furthermore, as shown in FIGS. 1, 4B and 4C, a clearance 45 corresponding to the thickness of the yoke 14 is formed between the inner peripheral surface of the cover portion 44 and the coil molding portion 26 exposed by the recess portion 33.

A circumferential dimension of the cover portion 44 is set larger than a circumferential dimension of the recess portion 33 in the circumferential direction, so that the cover portion 44 covers the entire area of the recess portion 33 in the circumferential direction, as shown in FIGS. 4B and 4C. One axial end of the cover portion 44 is connected to the connector portion 20, and the other axial end of the cover portion 44 extends to a portion adjacent to the open end of the recess portion 33, so as to cover all an area of the recess portion 33 except for a portion of the recess portion 33 adjacent to the open end (i.e., the end side of the axial open portion 35). Generally, at the other axial end side of the recess portion 33, a component is located so as to cover the other axial end side of the recess portion 33. Therefore, foreign-material mixed oil can not be sprinkled to the other axial end side of the recess portion 33 even if the cover portion 44 does not directly cover the other axial end side of the recess portion 33.

A tongue-shaped protrusion portion 46 is provided at the other axial end side of the cover portion 44 to protrude from a center portion of the cover portion 44 in the circumferential direction to the other axial end side, as shown in FIGS. 3 and 4A. The tongue-shaped protrusion portion 46 protrudes to the other end side in the axial direction more than the other end surface of the coil 19, to elastically contact the flange portion 38*a* of the stator 16, as shown in FIG. 1.

A holding portion 49 is provided at an inner peripheral side of the cover portion 44 to be connected to an outer peripheral surface of the coil molding portion 26, as shown in FIG. 2B. The holding portion 49 extends in the axial direction of the coil 19, and includes first and second leg portions 51, 52 arranged in the circumferential direction. As shown in FIG. 5A, both the first and second leg portions 51, 52 of the holding portion 49 are arranged in the recess portion 33 to have different length in the axial direction.

The first and second leg portions 51, 52 are formed from the secondary molding resin in the secondary molding to configure the secondary molding portion 21. The first and second leg portions 51, 52 protrude from the outer peripheral surface of the coil molding portion 26 to a radial outside, and is connected to an inner peripheral surface of the cover portion 44, so that the cover portion 44 is held at the outer peripheral side of the recess portion 33, as shown in FIGS. 4B and 4C.

As shown in FIG. 4A, the first leg portion 51 is positioned adjacent to one edge 53 of the recess portion 33 in the circumferential direction, and the second leg portion 52 is positioned adjacent to the other edge 54 of the recess portion 33 in the circumferential direction. A space 55 is provided between the first leg portion 51 and the second leg portion 52 in the circumferential direction. A dimension of the recess portion 33 in the circumferential direction is set larger than a dimension between the first leg portion 51 and the second leg portion 52 of the holding portion 49 in the circumferential direction.

As shown in FIG. 3, the coil 19 is inserted into the yoke 14 from the axial open portion 31 of the yoke 14, such that the connector portion 20 and the cover portion 44 are arranged outside of the yoke 14, and the holding portion 49 does not interfere with the yoke 14.

Figure 5B:
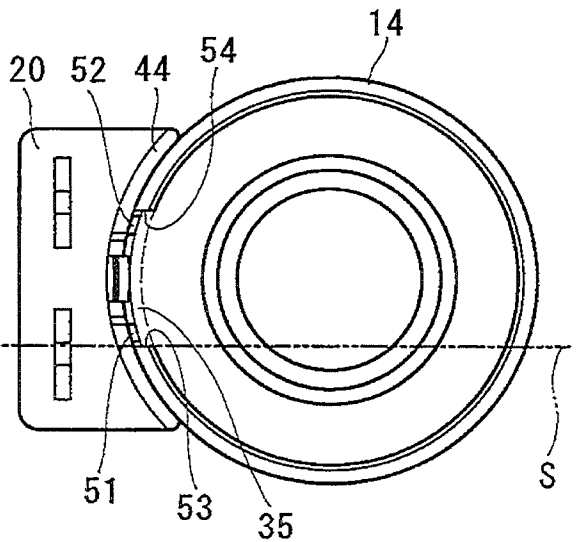
FIG. 5B is a schematic axial view showing an oil surface S in an interior of the yoke, according to the embodiment.
Figure 5A:
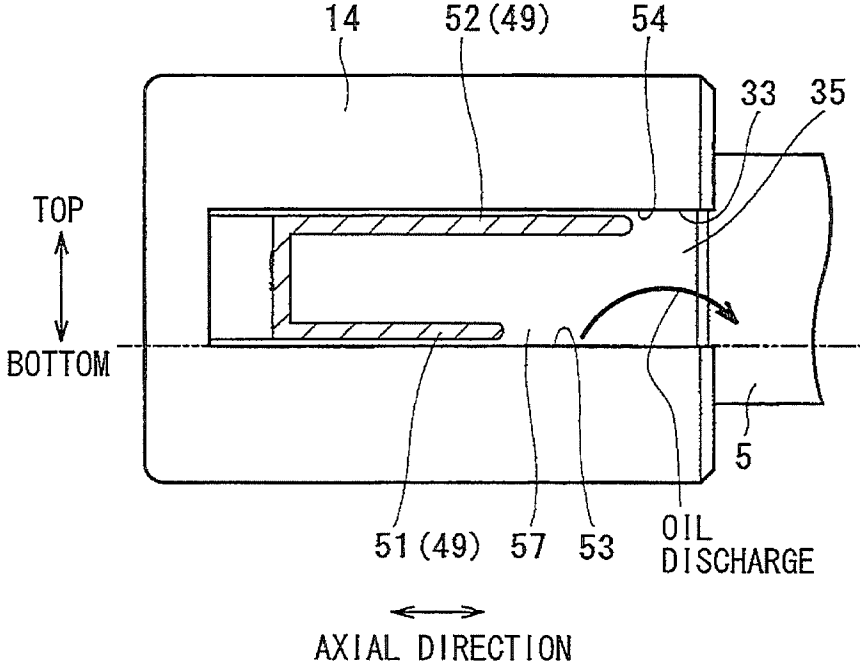
FIG. 5A is a schematic diagram showing a holding portion of the linear solenoid in which a cover portion is removed from the state shown in FIG. 4A.

The linear solenoid 1 is mounted, such that the recess portion 33 opened in the radial direction faces toward a horizontal direction, as shown in FIGS. 4A to 5B. As shown in FIG. 5B, the one edge 53 of the recess portion 33 is positioned at a lower side than the position of the other edge 54. Similarly, the first leg portion 51 adjacent to the one edge 53 is positioned lower than the second leg portion 52 adjacent to the other edge 54, in the holding portion 49.

Thus, the first leg portion 51 positioned at a lower side of the second leg portion 52 is shorter in the axial direction than the second leg portion 52 positioned at an upper side of the first leg portion 51, as shown in FIG. 5A. More specifically, the second leg portion 52 extends in the axial direction to the other axial end of the cover portion 44. In contrast, the first leg portion 51 is shorter than the second leg portion 52, thereby forming a space that is used as a discharge passage 57 extending to the axial open portion 35.

Next, effects of the present embodiment will be described.

In the linear solenoid 1 of the present embodiment, the cover portion 44 is formed by a part of the secondary molding resin that is used for the resin molding of the coil 19, to cover the recess portion 33 of the yoke 14 from an outer peripheral side of the recess portion 33. Thus, when foreign-material mixed oil is sprinkled to the linear solenoid 1, the cover portion 44 can prevent the foreign-material mixed oil from flowing into the yoke 14. Furthermore, the cover portion 44 is formed by using a part of the secondary molding resin to cover the recess portion 33, and thereby it is unnecessary to provide another separate cover member for covering the recess portion 33. Therefore, the number of the components can be reduced in the linear solenoid 1 with a simple structure.

The secondary molding portion 21 includes the holding portion 49 that protrudes from an outer peripheral surface of the coil molding portion 26 to hold the cover portion 44 at an outer peripheral side of the recess portion 33. The holding portion 49 includes the first and second leg portions 51, 52 that are arranged in the circumferential direction to extend in the axial direction, as shown in FIGS. 5A and 5B. Furthermore, the first leg portion 51 having an axial dimension shorter than that of the second leg portion 52 is arranged at a lower side of the second leg portion 52 in the top-bottom direction in a state where the linear solenoid 1 is mounted.

The one axial end of the first leg portion 51 is connected to the one axial end of the second leg portion 52 at the same axial position, and the other axial end of the first leg portion 51 is made shorter than the other axial end of the second leg portion 52 so as to form the discharge passage 57 through which foreign-material mixed oil is discharged toward the open portion 35 of the recess portion 33. Thus, even if foreign-material mixed oil is introduced into the yoke 14 from the recess portion 33, it is possible for the foreign-material mixed oil to be discharged to outside of the yoke 14, via the discharge passage 57 and the axial open portion 35 of the recess portion 33, as in the solid-line arrow shown in FIG. 5A. In FIGS. 5A and 5B, S schematically indicates the oil surface in the yoke 14.

Accordingly, even if foreign-material mixed oil is introduced into the yoke 14 from the recess portion 33, it can limit the foreign-material mixed oil from being stored more than a predetermined amount within the yoke 14, thereby reducing the oil position in the yoke 14. In the linear solenoid 1 of the present embodiment, the recess portion 33 provided in the circumferential direction is open in a horizontal direction. Thus, even when foreign-material mixed oil is introduced into the yoke 14, it is possible to easily discharge the foreign-material mixed oil to outside of the yoke 14 via the discharge passage 57 and the axial open portion 35. Therefore, it can prevent the oil level from rising more than the lower side edge 53 of the recess portion 33.

Modification

Although the present invention has been fully described in connection with the above example embodiment thereof with reference to the accompanying drawings, it is to be noted that various changes and modifications will become apparent to those skilled in the art.

For example, in the above-described embodiment, the other axial end side of the first leg portion 51 positioned at a lower side of the second leg portion 52 is made shorter, thereby forming the discharge passage 57. However, a slit extending in a circumferential direction may be provided at least at one position of the first leg portion 51 in the axial direction, so as to form the discharge passage 57.

In the above-described embodiment, the holding portion 49 is configured in a U-shape to have first and second leg portions 51, 52. However, the holding portion 49 may be formed without providing a space between the first and second leg portions 51 and 52. That is, the holding portion 49 may be formed to have one leg portion extending in the other axial end side. In this case, the discharge passage 57 may be provided at a side of the one leg portion or may be provided in the leg portion.

In the above-described embodiment, a part of the other axial end side of the recess portion 33 is not covered by the cover portion 44. However, the entire axial area of the recess portion 33 may be covered completely by the cover portion 44. For example, the other axial end of the cover portion 44 may extend more than the other axial end of the recess portion 33. In this case, because the entire area of the recess portion 33 is covered by the cover portion 44 in the circumferential direction and in the axial direction, it can prevent foreign-material mixed oil from being introduced into the inside of the yoke 14 from the recess portion 33 even when the foreign-material mixed oil is sprinkled to the yoke 14 from any direction.

In the above-described embodiment, the linear solenoid 1 of the present invention is typically used for the solenoid oil-pressure control valve 2. However, the linear solenoid of the present invention may be used for a valve device other than the solenoid oil-pressure control valve 2, a linear actuator or the like.

Such changes and modifications are to be understood as being within the scope of the present invention as defined by the appended claims.

What is claimed is:

1. A linear solenoid comprising:

a coil assembly including a coil which generates a magnetic flux when being energized; and a cup-shaped yoke arranged at an outer peripheral side of the coil and configured to pass therethrough the magnetic flux, wherein the yoke is provided with a recess portion that is opened at least at a position in a circumferential direction of the yoke and extends in an axial direction of the yoke, the coil assembly further includes a connector portion that has a terminal connected to an exterior and is exposed from the recess portion to an outside of the yoke, and a secondary molding portion made of a secondary molding resin in which the coil is insert-molded, the secondary molding portion includes a cover portion that is arranged to cover the recess portion of the yoke from an outer peripheral side of the recess portion, the secondary molding portion further includes a holding portion that protrudes from an outer periphery of the coil to an outer peripheral side and holds the cover portion at the outer peripheral side of the recess portion of the yoke, the holding portion includes first and second leg portions that are arranged in the circumferential direction and extend in the axial direction, the cover portion extends in the circumferential direction and the axial direction to form a part of a cylindrical wall, and the cover portion is larger than the recess portion in dimension in the circumferential direction.

2. The linear solenoid according to claim 1, wherein the secondary molding portion further includes a coil molding portion arranged to cover an outer periphery of the coil, and the holding portion is provided with a discharge passage through which oil flowing out of the recess portion is discharged toward an axial open portion of the recess portion.

3. The linear solenoid according to claim 1, wherein the cover portion is arranged to cover an entire area of the recess portion in the axial direction and in the circumferential direction.

4. The linear solenoid according to claim 1, wherein the recess portion is an open portion that is opened in a circumferential wall of the yoke and extends in a range in the circumferential direction, the recess portion extends in the axial direction to an axial open portion of the yoke, and the cover portion extends from the connector portion toward the axial open portion of the yoke in the axial direction.

5. The linear solenoid according to claim 1, wherein the cover portion has an inner peripheral surface being in contact with an outer peripheral surface of the yoke.

6. A linear solenoid comprising:

a coil assembly including a coil which generates a magnetic flux when being energized; and a cup-shaped yoke arranged at an outer peripheral side of the coil and configured to pass therethrough the magnetic flux, wherein the yoke is provided with a recess portion that is opened at least at a position in a circumferential direction of the yoke and extends in an axial direction of the yoke, the coil assembly further includes a connector portion that has a terminal connected to an exterior and is exposed from the recess portion to an outside of the yoke, and a secondary molding portion made of a secondary molding resin in which the coil is insert-molded, the secondary molding portion includes a cover portion that is arranged to cover the recess portion of the yoke from an outer peripheral side of the recess portion, the secondary molding portion further includes a coil molding portion arranged to cover an outer periphery of the coil, and a holding portion that protrudes from an outer periphery of the coil molding portion to an outer peripheral side and holds the cover portion at the outer peripheral side of the recess portion of the yoke, the holding portion is provided with a discharge passage through which oil flowing out of the recess portion is discharged toward an axial open portion of the recess portion, the holding portion includes first and second leg portions that are arranged in the circumferential direction and extend in the axial direction, and the first leg portion is positioned at a lower side of the second leg portion and is provided with the discharge passage.

* * * * *